US009355598B2

(12) United States Patent
Jung et al.

(10) Patent No.: US 9,355,598 B2
(45) Date of Patent: May 31, 2016

(54) TRANSPARENT DISPLAY APPARATUS AND CONTROLLING METHOD THEREOF

(71) Applicant: SAMSUNG ELECTRONICS CO., LTD., Suwon-si, Gyeonggi-do (KR)

(72) Inventors: Ho-young Jung, Yongin-si (KR); Jeong-ryeol Seo, Seongnam-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 25 days.

(21) Appl. No.: 14/069,902

(22) Filed: Nov. 1, 2013

(65) Prior Publication Data

US 2014/0125640 A1 May 8, 2014

(30) Foreign Application Priority Data

Nov. 8, 2012 (KR) ..... 10-2012-0126117

(51) Int. Cl.
*G09G 3/34* (2006.01)
*G09G 5/10* (2006.01)

(52) U.S. Cl.
CPC .. *G09G 3/34* (2013.01); *G09G 5/10* (2013.01); *G09G 2320/0247* (2013.01); *G09G 2330/021* (2013.01); *G09G 2330/027* (2013.01); *G09G 2380/02* (2013.01)

(58) Field of Classification Search
None
See application file for complete search history.

(56) References Cited

U.S. PATENT DOCUMENTS

2006/0012552 A1* 1/2006 Chiu et al. ..... 345/87
2006/0044286 A1* 3/2006 Kohlhaas et al. ..... 345/173
2012/0242678 A1* 9/2012 Border et al. ..... 345/589

OTHER PUBLICATIONS

European Search Report issued Aug. 27, 2014 in corresponding European Patent Application No. 13191067.1.

* cited by examiner

*Primary Examiner* — Kenneth B Lee, Jr.
(74) *Attorney, Agent, or Firm* — Staas & Halsey LLP

(57) ABSTRACT

A transparent display apparatus and a controlling method thereof include a transparent display panel which displays an image, a backlight unit which provides backlight to the transparent display panel, an input unit which receives a user command, a power supply unit which supplies power to the transparent display apparatus, and a controller which controls the power supply unit to cut off power supply to the backlight unit if a preset command is input through the input unit, controls the transparent display panel to output a preset image, and controls the power supply unit to cut off power supply to the transparent display panel after a preset time has elapsed.

20 Claims, 4 Drawing Sheets

TRANSPARENT DISPLAY APPARATUS AND CONTROLLING METHOD THEREOF

CROSS-REFERENCE TO RELATED APPLICATIONS

This application claims priority from Korean Patent Application No. 10-2012-0126117, filed on Nov. 8, 2012, in the Korean Intellectual Property Office, the disclosure of which is incorporated herein by reference in its entirety.

BACKGROUND

1. Field

One or more embodiments relate to a transparent display apparatus and a controlling method thereof, and more particularly, to a transparent display apparatus capable of turning the power off without a transient phenomenon when the user inputs a command to turn the power off, and a controlling method thereof.

2. Description of the Related Art

With development of the electronic technology, diverse types of display apparatuses are used in various fields. In particular, research of advanced display apparatuses such as transparent displays has been actively carried out recently.

A transparent display apparatus is a display apparatus which is transparent so that a background behind the display apparatus can be shown. In the related art, display panels are made of an opaque semiconductor compound such as silicon (Si) and gallium arsenide (GaAs). However, as diverse application fields which cannot be handled by related art display panels have been developed, efforts to develop new types of electronic elements have been made. One of them is transparent display apparatuses.

Transparent display apparatuses include a transparent oxide semiconductor film, thereby featuring transparency. If a transparent display apparatus is used, the user can watch necessary information on the screen of the transparent display apparatus while seeing a background behind the apparatus. Accordingly, since constraints of space and time of related-art display apparatuses may be resolved, transparent display apparatuses may be conveniently used in diverse environments with diverse usages.

A transparent display panel constituting such a transparent display apparatus has a thinner film than general display panels and works without a backlight which is provided behind general display panels, thereby maintaining transparency when the power is turned off. The transparent display panel has a lower color reproduction rate than general display panels, but if light is emitted by adding a backlight unit on an edge of the display panel or adding a light source at a separate space, the viewer may watch an image on the transparent display panel.

If a command to turn the power off is input, general display apparatuses cut off the power supplied to a backlight unit firstly. Thus, backlight is not output, so although an image is being output on a display panel, the display panel maintains a black screen. Accordingly, when the power is not supplied to the display panel, the general display apparatuses do not cause a transient phenomenon in which the image output to the display panel is temporarily distorted.

However, in a transparent display apparatus, if a command to turn the power off is input and the power supplied to the backlight unit is cut off firstly, the viewer may still watch an output image due to the nature of the transparent display panel. That is, although the power is cut off to the transparent display panel, the image is output to the display panel. Therefore, there is a problem that the viewer may watch a distorted image temporarily on the transparent display panel.

SUMMARY

The foregoing described problems may be overcome and/or other aspects may be achieved by one or more embodiments of a transparent display apparatus which may prevent the transient phenomenon when a power-off command is input to the transparent display apparatus, and a controlling method thereof.

According to one or more embodiments, a transparent display apparatus may include a transparent display panel which may display an image, a backlight unit which may provide backlight to the transparent display panel, an input unit which may receive a user command, a power supply unit which may supply power to the transparent display apparatus, and a controller which may control the power supply unit to cut off power supply to the backlight unit if a preset command is input through the input unit, may control the transparent display panel to output a preset image, and may control the power supply unit to cut off power supply to the transparent display panel after a preset time has elapsed.

The preset image may be a transparent image which is pre-stored in the transparent display apparatus.

The transparent display apparatus may further include a timing controller which controls an image output timing of the transparent display apparatus and may include an electrically erasable and programmable read-only memory (EEPROM), wherein the transparent image may be pre-stored in the EEPROM.

The transparent display apparatus may further include an image processing unit which may process an image signal to be displayed on the transparent display panel, wherein the controller may control the timing controller and the transparent display panel to stop outputting the image signal processed by the image processing unit to the transparent display panel and to output the transparent image stored in the EEPROM.

The controller may control the power supply unit to cut off power supply to the transparent display panel while maintaining output of the preset image during, for example, 1 to 3 seconds.

The input unit may be a remote controller, and the preset command may be a command to press a power-off button provided on the remote controller.

According to one or more embodiments, a controlling method of a transparent display apparatus may include cutting off power supply to a backlight unit of the transparent display apparatus if a preset command is input by a user, outputting a preset image onto a transparent display panel, and cutting off power supply to the transparent display panel after a preset time has elapsed.

The preset image may be a transparent image which is pre-stored in the transparent display apparatus.

The transparent display apparatus may include a timing controller including an electrically erasable and programmable read-only memory (EEPROM), wherein the transparent image may be pre-stored in the EEPROM.

The outputting of the preset image may include stopping outputting a signal-processed image signal to the transparent display panel if the preset command is input, and outputting the transparent image stored in the EEPROM.

When cutting off power supply to the transparent display panel, the power supply to the transparent display panel may be cut off while output of the preset image is maintained, for example, during 1 to 3 seconds.

The preset command may be a command to press a power-off button provided on a remote controller to control the transparent display apparatus.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
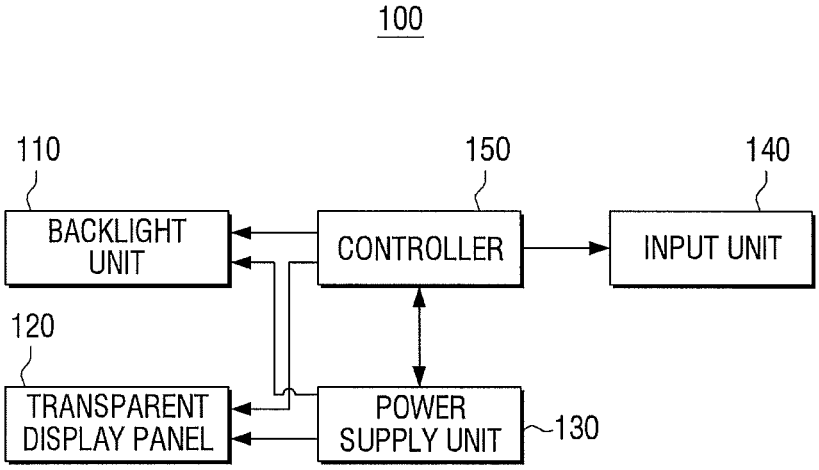
FIG. 1 is a schematic block diagram illustrating a configuration of a transparent display apparatus according to one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

FIG. 1 is a schematic block diagram illustrating a configuration of a transparent display apparatus 100 according to one or more embodiments. As shown in FIG. 1, the transparent display apparatus 100 may include a backlight unit 110, a transparent display panel 120, a power supply unit 130, an input unit 140, and a controller 150. The transparent display apparatus 100 may be employed in diverse types of devices such as, for example, windows, head-up display (HUD) systems, helmet-mount display (HMD) systems, notebook computers, personal computer (PC) monitors, televisions, personal digital assistants (PDAs), electronic picture frames, tablet PCs, cameras, and the like.

FIG. 1 is a view to describe functions of the transparent display apparatus 100 according to one or more embodiments. Accordingly, according to one or more embodiments, some of the components shown in FIG. 1 may be omitted or modified, and further components may be added.

The backlight unit 110 may provide backlight to the transparent display panel 120 so that the transparent display panel 120 may display an image.

Figure 2:
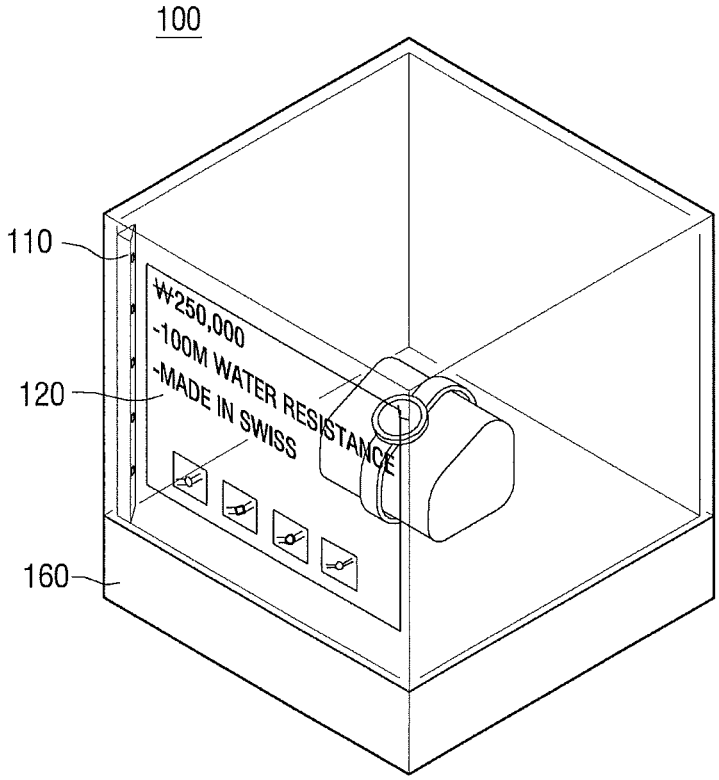
FIG. 2 illustrates an exterior of a transparent display apparatus according to one or more embodiments.

When the transparent display panel 120 uses an element which does not emit light autonomously such as a liquid crystal display (LCD), adjacent light such as natural light may be used if the backlight unit 110 is not provided. As a result, a luminance and a color reproduction rate may decrease notably. On the other hand, if the backlight unit 110 is provided behind the transparent display panel 120, the transparent display panel 120 may become opaque. Accordingly, the purpose of the transparent display panel 120 may not be achieved. Therefore, the backlight unit 110 may be provided on one side of the transparent display panel 120 as shown in FIG. 2. As depicted in FIG. 2, the backlight unit 110 may be provided on a left side of the transparent display panel 120, but this is merely an exemplary embodiment. The backlight unit 110 may be provided on any other side (e.g. an upper side) of the transparent display panel 120. As above, the backlight unit 110 may be provided on one side of the transparent display panel 120, but this is merely an exemplary embodiment. The backlight unit 110 may be provided on an edge of the other surface of the transparent display panel 120.

The transparent display panel 120 may display an image input by the controller 150. The transparent display panel 120 may display an image by transmitting a voltage to transparent elements while an object positioned behind the transparent display panel 120 may be transparently shown. An image to be displayed on the transparent display panel 120 may include, for example, images, text, content reproduction screen, application execution screen, web browser screen, diverse graphic objects, and the like.

In particular, the transparent display panel 120 according to one or more embodiments may be implemented in a transparent LCD type. The transparent LCD type is a transparent display apparatus including a transparent display panel which is implemented using a pair of polarizing plates, an optical film, a transparent thin film transistor, a transparent electrode, and so on. The transparent LCD may provide a backlight unit on one side of the transparent display panel 120 in order to increase a luminance and color reproduction.

Figure 3:
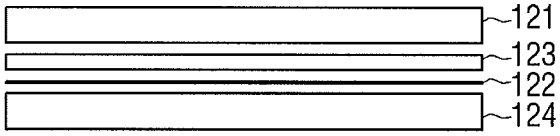
FIG. 3 illustrates a cross section of a transparent display panel according to one or more embodiments.

The transparent display panel 120 is described in greater detail with reference to FIG. 3. As shown in FIG. 3, the transparent display panel 120 of a transparent LCD type may include an upper transparent panel 121, a filter 122, an LCD panel 123, and a lower transparent panel 124.

The upper transparent panel 121 may be disposed on the highest surface of the transparent display panel 120 to possibly prevent damage of the transparent display panel 120. The upper transparent panel 121 may be made, for example, of a transparent acrylic or polymeric material, and may also be made of a material such as hardened protection glass as occasion demands. The upper transparent panel 121 may be spaced apart from the LCD panel 123 at a predetermined distance since heat of the LCD panel 123 may thermally deform the upper transparent panel 121. In addition, if the upper transparent panel 121 is physically in contact with an object, the durability of the LCD panel 123 may decrease.

The filter 122 may be disposed between the LCD panel 123 and a light source to transmit emitted light to the LCD panel 123 uniformly.

In addition, the lower transparent panel 124 which may be made of the same material as the upper transparent panel 121 may be spaced apart from the LCD panel 123 at a predetermined distance under the LCD panel 123. The lower transparent panel 124 may support the LCD panel 123 and the filter 122 under the LCD panel 123, and may be replaced, for example, with a hardened protection glass.

The LCD panel 123 may convert diverse electrical information into visual information using the change of liquid crystal transmittance in accordance with a transmitted voltage. The LCD panel 123 may include a lower plate on which a transparent thin film transistor (TFT) and a pixel electrode may be arranged, an upper plate (not shown) on which a color filter to represent color and a transparent common electrode may be disposed, and a liquid crystal (not shown) inserted between the two glass substrates. Polarizing plates (not shown) may be attached to both surfaces of the two glass substrates to polarize a visible ray (natural light). The liquid crystal inserted between the upper and lower electrodes may form a capacitor and an auxiliary capacitor so that image information may be expressed.

The transparent thin film transistor (not shown) may be a transistor manufactured by replacing an opaque silicon of a general thin film transistor with a transparent material such as, for example, a transparent zinc oxide, an oxide titanium, and the like, forming a layer of the LCD panel 123. In the transparent thin film transistor layer (not shown), a source, a gate, and a drain may be provided, and a plurality of transistors uniformly distributed on the entire surface of the display may be provided. The controller 150 may display information by transmitting a control signal to a gate of each transparent thin film transistor in the transparent thin film transistor layer and thus driving a corresponding transparent thin film transistor.

Each transparent electrode (not shown) may include a plurality of line electrodes which may be arranged perpendicular to those of the other transparent electrode. For example, if the line electrodes of a first transparent electrode are horizontally arranged, the line electrodes of a second transparent electrode may be vertically arranged. Accordingly, a plurality of cross regions may be formed between the first and second transparent electrodes. Each cross region may be connected to a transparent thin film transistor.

The transparent electrode may be made, for example, of indium tin oxide (ITO) or a new material such as graphene. Graphene is an atomic-scale honeycomb lattice made of carbon atoms and has transparency.

If the transistor is turned on by transmitting a voltage to a gate of the transparent thin film transistor constituting a pixel, an image voltage may be input to the liquid crystal. If the transistor is turned off after image information is stored in the liquid crystal by inputting the image voltage to the liquid crystal, an electrical charge stored in a liquid crystal charger and an auxiliary charger may display an image during a predetermined time. If a voltage is transmitted to the liquid crystal, the arrangement of the liquid crystal is transformed. In this state, if light passes through the liquid crystal, diffraction may be caused. Subsequently, if the light penetrates the polarizing plate, a desired image is obtained.

Returning to FIG. 1, the power supply unit 130 may supply the power to the components of the transparent display apparatus 100 according to control of the controller 150. In particular, if a command to turn the power on is input through the input unit 140, the power supply unit 130 may supply the power to the backlight unit 110, transparent display panel 120, and controller 150. In addition, if a command to turn the power off is input through the input unit 140, the power supply unit 130 may firstly cut off the power supply to the backlight unit 110 and may cut off the power supply to the transparent display panel 120 after a predetermined time.

The input unit 140 may receive a user command to control the transparent display apparatus 100. In particular, the input unit 140 may receive a user command to turn off the transparent display apparatus 100 (referred to as a "power-off command").

According to one or more embodiments, the input unit 140 may be implemented, for example, with a remote controller, but this is merely an exemplary embodiment. The input unit 140 may also be implemented, for example, with diverse devices such as a touch panel, a pointing device, and the like.

The controller 150 may control overall operations of the transparent display apparatus 100 in accordance with a user command input through the input unit 140. In particular, if a preset command is input through the input unit 140, the controller 150 may control the power supply unit 130 to cut off the power supply to the backlight unit 110. In addition, the controller 150 may control the transparent display panel 120 to output a preset image. Then, after a preset time has elapsed, the controller 150 may control the power supply unit 130 to cut off the power supply to the transparent display panel 120.

More specifically, if a power-off command is input through the input unit 140, the controller 150 may control the power supply unit 140 to firstly cut off the power supply to the backlight unit 110. The power-off command may be a user command to press a power-off button provided on a remote controller.

Subsequently, the controller 150 may control the display panel 120 to stop image output of an image processing unit (not shown) which processes an input image and to output a preset image. Herein, in order to output a transparent image, the controller 150 may control the transparent display panel 120 to show a background behind the transparent display apparatus 100 by transforming arrangement of the liquid crystal of the transparent display panel 120.

The present image may be a transparent image pre-stored in the transparent display apparatus 100. According to one or more embodiments, the transparent image may be pre-stored, for example, in an electrically erasable and programmable read-only memory (EEPROM) of a timing controller (not shown) which may control an image output timing of the transparent display apparatus 100. If the transparent image is pre-stored, such as in the EEPROM of the timing controller, the controller 150 may control the timing controller and the transparent display panel 120 to stop outputting an image signal processed by the image processing unit to the transparent display panel 120 using, for example, a low voltage differential signaling (LVDS) line and to output the transparent image stored in the EEPROM.

However, pre-storing the transparent image in the EEPROM of the timing controller as described above is merely an exemplary embodiment. The transparent image may also be pre-stored in any other storage media of the transparent display apparatus 100.

Furthermore, the controller 150 may maintain output of the pre-stored transparent image during a preset time. The preset time may be, for example, 1 to 3 seconds.

In addition, while maintaining output of the pre-stored transparent image during the preset time, the controller 150 may control the power supply unit 140 to cut off the power supply to the transparent display panel 120.

That is, although the power supply to the backlight unit 110 may be cut off, the power supply to the transparent display panel 120 may be cut off while the transparent image is being displayed. Accordingly, when the transparent display apparatus 100 is turned off, the transient phenomenon in which an image is temporarily distorted may be prevented.

The power supply unit 130, controller 150, image processing unit (not shown), and timing controller (not shown) may be provided in a main body 160 as illustrated in FIG. 2.

Figure 4:
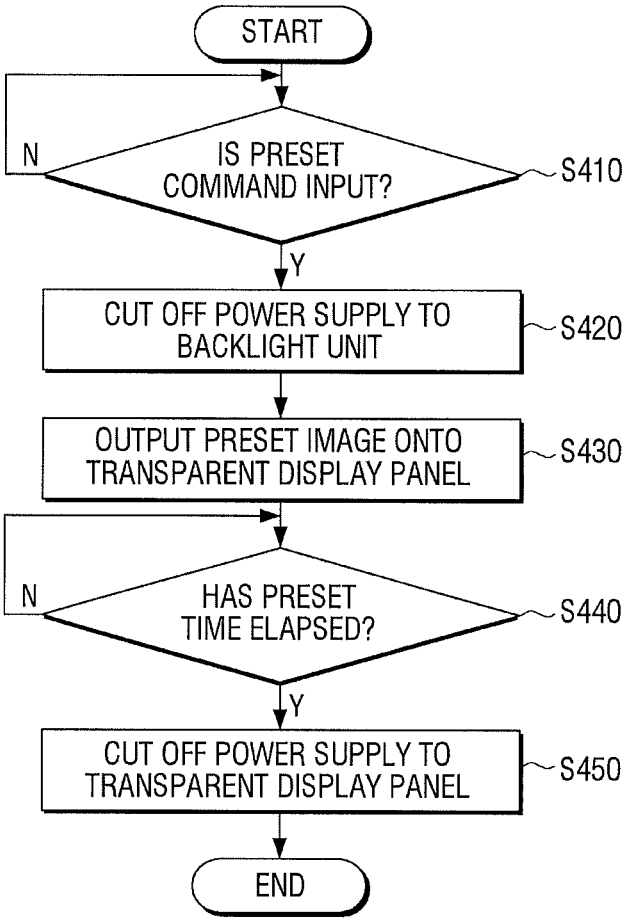
FIG. 4 is a flow chart illustrating a controlling method of a transparent display apparatus according to one or more embodiments.

A method for controlling power-off of the transparent display apparatus 100 according to one or more embodiments is described with reference to FIG. 4.

In operation S410, the transparent display apparatus 100 may determine whether a preset command is input by the user. The preset command may be a power-off command which may be input, for example, by selecting a power-off button provided on a remote controller.

If the preset command is input in operation S410-Y, the transparent display apparatus 100 may cut off off the power supply to the backlight unit 110 in operation S420.

In operation S430, the transparent display apparatus 100 may output a preset image on the transparent display panel 120. The preset image may be a transparent image which may be pre-stored in the transparent display apparatus 100. More specifically, the preset image may be pre-stored in a storage medium (e.g. an EEPROM of the timing controller) of the transparent display apparatus 100.

In addition, when outputting the preset image onto the transparent display panel 120, the transparent display apparatus 100 may stop output of an image which is being output.

Subsequently, in operation S440, the transparent display apparatus 100 may determine whether a preset time has elapsed. The preset time may be, for example, 1 to 3 seconds.

If the preset time has elapsed in operation S440-Y, the transparent display apparatus 100 may cut off the power supply to the transparent display panel 120 in operation S450. While outputting a transparent image on the transparent display panel 120, the transparent display apparatus 100 may cut off the power supply to the transparent display panel 120.

According to the method for controlling power-off of the transparent display apparatus 100 as described above, the power supply to the transparent display panel 120 may be cut off while the transparent image is being displayed. As a result, the transient phenomenon which is caused when the transparent display apparatus 100 is turned off may be be prevented.

The controlling method of the transparent display apparatus according to one or more embodiments may be programmed and provided in the display apparatus.

Specifically, a program may be made, including cutting off the power supply to the backlight unit of the transparent display apparatus if the preset command is input by the user, outputting the preset image to the transparent display panel, and cutting off the power supply to the transparent display panel after the preset time has elapsed, and may be stored and provided in a non-transitory computer readable medium.

In one or more embodiments, any apparatus, system, element, or interpretable unit descriptions herein include one or more hardware devices or hardware processing elements. For example, in one or more embodiments, any described apparatus, system, element, retriever, pre or post-processing elements, tracker, detector, encoder, decoder, etc., may further include one or more memories and/or processing elements, and any hardware input/output transmission devices, or represent operating portions/aspects of one or more respective processing elements or devices. Further, the term apparatus should be considered synonymous with elements of a physical system, not limited to a single device or enclosure or all described elements embodied in single respective enclosures in all embodiments, but rather, depending on embodiment, is open to being embodied together or separately in differing enclosures and/or locations through differing hardware elements.

In addition to the above described embodiments, embodiments can also be implemented through computer readable code/instructions in/on a non-transitory medium, e.g., a computer readable medium, to control at least one processing device, such as a processor or computer, to implement any above described embodiment. The medium can correspond to any defined, measurable, and tangible structure permitting the storing and/or transmission of the computer readable code.

The media may also include, e.g., in combination with the computer readable code, data files, data structures, and the like. One or more embodiments of computer-readable media include: magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Computer readable code may include both machine code, such as produced by a compiler, and files containing higher level code that may be executed by the computer using an interpreter, for example. The media may also be any defined, measurable, and tangible distributed network, so that the computer readable code is stored and executed in a distributed fashion. Still further, as only an example, the processing element could include a processor or a computer processor, and processing elements may be distributed and/or included in a single device.

The computer-readable media may also be embodied in at least one application specific integrated circuit (ASIC) or Field Programmable Gate Array (FPGA), as only examples, which execute (e.g., processes like a processor) program instructions.

While aspects of the present invention has been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A transparent display apparatus comprising:

a transparent display panel which displays an image;

a backlight unit which provides backlight to the transparent display panel;

an input unit which receives a user command;

a power supply unit which supplies power to the transparent display apparatus; and a controller which controls the power supply unit to cut off a power supply to the backlight unit if a preset command is input through the input unit, controls the transparent display panel to output a preset image, and controls the power supply unit to cut off power supply to the transparent display panel after the power supply to the backlight unit is cut off and after a preset time has elapsed, wherein the preset time is started when the power supply to the backlight unit is cut off, and wherein the preset image is output transparently by the transparent display panel such that a background behind the transparent display panel is shown.

2. The transparent display apparatus as claimed in claim 1, wherein the preset image is pre-stored in the transparent display apparatus.

3. The transparent display apparatus as claimed in claim 2, further comprising:

a timing controller which controls an image output timing of the transparent display apparatus, the timing controller comprising an electrically erasable and programmable read-only memory (EEPROM), wherein the transparent image is pre-stored in the EEPROM.

4. The transparent display apparatus as claimed in claim 3, further comprising:

an image processing unit which processes an image signal to be displayed on the transparent display panel, wherein the controller controls the timing controller and the transparent display panel to stop outputting the image signal processed by the image processing unit to the transparent display panel and to output the transparent image stored in the EEPROM.

5. The transparent display apparatus as claimed in claim 1, wherein the controller controls the power supply unit to cut off power supply to the transparent display panel while maintaining output of the preset image for a duration of about 1 to 3 seconds.

6. The transparent display apparatus as claimed in claim 1, wherein the input unit is a remote controller, and the preset command corresponds to pressing a power-off button provided on the remote controller.

7. A controlling method of a transparent display apparatus, the method comprising:

cutting off power supply to a backlight unit of the transparent display apparatus if a preset command is input by a user;

outputting a preset image onto a transparent display panel; and cutting off power supply to the transparent display panel after the power supply to the backlight unit is cut off and after a preset time has elapsed, wherein the preset time is started when the power supply to the backlight unit is cut off, and wherein the preset image is output transparently by the transparent display panel such that a background behind the transparent display panel is shown.

8. The method as claimed in claim 7, wherein the preset image is pre-stored in the transparent display apparatus.

9. The method as claimed in claim 8, wherein the transparent display apparatus comprises a timing controller including an electrically erasable and programmable read-only memory (EEPROM), and wherein the transparent image is pre-stored in the EEPROM.

10. The method as claimed in claim 9, wherein the outputting of the preset image comprises:

stopping outputting a signal-processed image signal to the transparent display panel if the preset command is input; and outputting the transparent image stored in the EEPROM.

11. The method as claimed in claim 7, wherein when cutting off power supply to the transparent display panel, the power supply to the transparent display panel is cut off while output of the preset image is maintained for a duration of about 1 to 3 seconds.

12. The method as claimed in claim 7, wherein the preset command corresponds to pressing a power-off button provided on a remote controller to control the transparent display apparatus.

13. A controlling method of a transparent display apparatus, the method comprising:

cutting off power supply to a backlight unit of the transparent display apparatus;

outputting an image onto a transparent display panel; and cutting off power supply to the transparent display panel after the power supply to the backlight unit is cut off and after a predetermined time has elapsed, wherein the predetermined time is started when the power supply to the backlight unit is cut off, and wherein the image is output transparently by the transparent display panel such that a background behind the transparent display panel is shown.

14. The method as claimed in claim 13, wherein the image is pre-stored in the transparent display apparatus.

15. The method as claimed in claim 14, wherein the transparent display apparatus comprises a timing controller including a storage unit.

16. The method as claimed in claim 15, wherein the outputting of the image comprises:

stopping outputting a signal-processed image signal to the transparent display panel; and outputting the transparent image stored in the storage unit of the timing controller.

17. The method as claimed in claim 14, wherein the storage unit of the timing controller comprises an electrically erasable and programmable read-only memory (EEPROM), and wherein the transparent image is pre-stored in the EEPROM.

18. The method as claimed in claim 13, wherein when cutting off power supply to the transparent display panel, the power supply to the transparent display panel is cut off while output of the image is maintained for a duration of about 1 to 3 seconds.

19. The method as claimed in claim 13, wherein the power supply to the backlight unit is cut off if a command is input by a user, the preset command corresponding to pressing a power-off button provided on a remote controller to control the transparent display apparatus.

20. The method as claimed in claim 13, wherein the predetermined time can be adjusted.

* * * * *